US006708656B1

(12) United States Patent
Chang

(10) Patent No.: US 6,708,656 B1
(45) Date of Patent: Mar. 23, 2004

(54) ENGINE VALVE ACTUATOR

(75) Inventor: David Y. Chang, Savoy, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/322,483

(22) Filed: Dec. 19, 2002

(51) Int. Cl.[7] ..... F01L 9/02
(52) U.S. Cl. ..... 123/90.12; 92/13.6; 92/13.8
(58) Field of Search ..... 123/90.12; 92/13.6, 92/13.8, 8

(56) References Cited

U.S. PATENT DOCUMENTS 4,655,178 A * 4/1987 Meneely ..... 123/321
4,706,625 A 11/1987 Meistrick et al.
4,898,128 A 2/1990 Meneely
5,036,810 A 8/1991 Meneely
5,161,501 A 11/1992 Hu
5,460,131 A 10/1995 Usko
5,511,460 A 4/1996 Custer
6,192,841 B1 2/2001 Vorih et al.
6,273,057 B1 8/2001 Schwoerer et al.
6,302,370 B1 10/2001 Schwoerer et al.
6,481,333 B1 * 11/2002 Akasaka et al. ..... 92/13.6

* cited by examiner

*Primary Examiner*—Thomas Denion
*Assistant Examiner*—Zelalem Eshete
(74) *Attorney, Agent, or Firm*—Finnegan, Henderson, Farabow, Garrett & Dunner

(57) ABSTRACT

An engine valve actuator for an internal combustion engine is provided. The engine valve actuator includes a housing having an opening. An adjustment member is disposed in the housing and defines a chamber. A piston is disposed in the opening of the housing and has a protrusion adapted to be received in the chamber of the adjustment member. The piston has a first position where the protrusion of the piston is disposed in the chamber and a portion of the piston contacts a corresponding portion of the adjustment member and a second position where the portion of the piston is separated from the corresponding portion of the adjustment member. A fluid passageway is adapted to provide pressurized fluid to the opening. The pressurized fluid acts on the piston to move the piston towards the second position to thereby allow pressurized fluid to enter the chamber to prevent the piston from returning to the first position. A push rod is operatively engaged with the piston and is adapted to engage and open the engine valve.

20 Claims, 3 Drawing Sheets

ENGINE VALVE ACTUATOR

TECHNICAL FIELD

The present disclosure is directed to an engine valve actuator and, more particularly, the present disclosure is directed to an anti-lash mechanism for an engine valve actuator.

BACKGROUND

Many vehicles, such as, for example, automobiles, on highway trucks, or off highway trucks, typically include an internal combustion engine that provides power for the vehicle. A typical internal combustion engine includes a series of intake and exhaust valves that control the flow of gases to and from the combustion chambers of the engine. The engine may also include a valve actuation system, such as, for example, a cam driven valve actuation system to control the actuation timing of the engine valves.

The overall performance of the internal combustion engine may be improved by using a series of auxiliary valve actuators, such as, for example, hydraulically powered actuators, that actuate the engine valves to selectively implement variations on the conventional, cam-driven valve timing. For example, the auxiliary valve actuators may be used to actuate the exhaust valves of the engine to implement an "engine braking" cycle. In an engine braking cycle, the auxiliary valve actuators open the exhaust valves of the engine when a piston associated with each combustion chamber is at or near a top-dead-center position of a compression stroke. This opening of the exhaust valves allows the air compressed by the piston in the combustion chamber during the compression stroke to escape from the combustion chamber through an exhaust passageway. In this manner, the pistons of the engine are selectively used as air compressors to absorb power instead of generating power in response to the combustion of fuel.

Because the auxiliary valve actuators are used only when the engine is experiencing selected operating conditions, the auxiliary valve actuators should avoid interfering with the operation of the cam driven valve actuation system when the engine is experiencing other operating conditions. The performance of the engine may be negatively impacted if, for example, the auxiliary valve actuators inadvertently opened the exhaust valves during the intake stroke of the pistons. This type of interference may occur if the auxiliary valve actuators do not account for changes in the size of engine components due to thermal expansion.

To prevent any such interference, the auxiliary valve actuators are typically separated from the exhaust valve assembly by a certain distance, which is commonly referred to as a "lash." The lash is a distance that separates the auxiliary valve actuators from the engine valve assembly. The lash may prevent inadvertent or unintentional opening of the engine valves by the auxiliary valve actuators when changes in temperature of the engine cause a change in size of the engine components.

However, the auxiliary valve actuators must take up the lash before engaging the engine valves to open the engine valves. This may result in the auxiliary valve actuators requiring additional fluid and/or additional time to open an associated engine valve. To obtain the best engine performance, the actuation timing of the engine valves should be controlled precisely. Accordingly, the system that controls the auxiliary valve actuators must account for the lash in each actuation of the associated engine valves.

An auxiliary valve actuator may include an anti-lash mechanism. For example, as illustrated in U.S. Pat. No. 4,898,128 to Meneely, an auxiliary valve actuator may include a relatively low force spring that biases the valve actuator into contact with the valve assembly. In this manner, the lash is removed and the auxiliary valve actuator remains in contact with the associated valve without impacting the performance of the engine under normal operating conditions. However, adding additional components to the auxiliary valve actuator increases the overall cost of the auxiliary actuator and may result in additional maintenance.

The engine valve actuator of the present disclosure solves one or more of the problems set forth above.

SUMMARY OF THE INVENTION

In one aspect, the present disclosure is directed to an engine valve actuator for an internal combustion engine that includes a housing having an opening. An adjustment member is disposed in the housing and defines a chamber. A piston is disposed in the opening of the housing and has a protrusion adapted to be received in the chamber of the adjustment member. The piston has a first position where the protrusion of the piston is disposed in the chamber and a portion of the piston contacts a corresponding portion of the adjustment member and a second position where the portion of the piston is separated from the corresponding portion of the adjustment member. A fluid passageway is adapted to provide pressurized fluid to the opening. The pressurized fluid acts on the piston to move the piston towards the second position to thereby allow pressurized fluid to enter the chamber to prevent the piston from returning to the first position. A push rod is operatively engaged with the piston and is adapted to engage and open the engine valve.

In another aspect, the present disclosure is directed to a method of an engine valve of an internal combustion engine. Pressurized fluid is provided to a housing defining an opening and including a chamber. The pressurized fluid is directed to the opening of the housing and against a piston having a protrusion engaged with the chamber. The pressurized fluid acts on the piston to move the piston from a first position where a portion of the piston engages a corresponding portion of the housing. The movement of the piston cause the engine valve to move to an open position and allows fluid to flow into the chamber. The engine valve is returned to a closed position. The movement of the engine valve acts to move the piston within the housing. The fluid in the chamber prevents the piston from returning to the first position.

DETAILED DESCRIPTION

Figure 1:
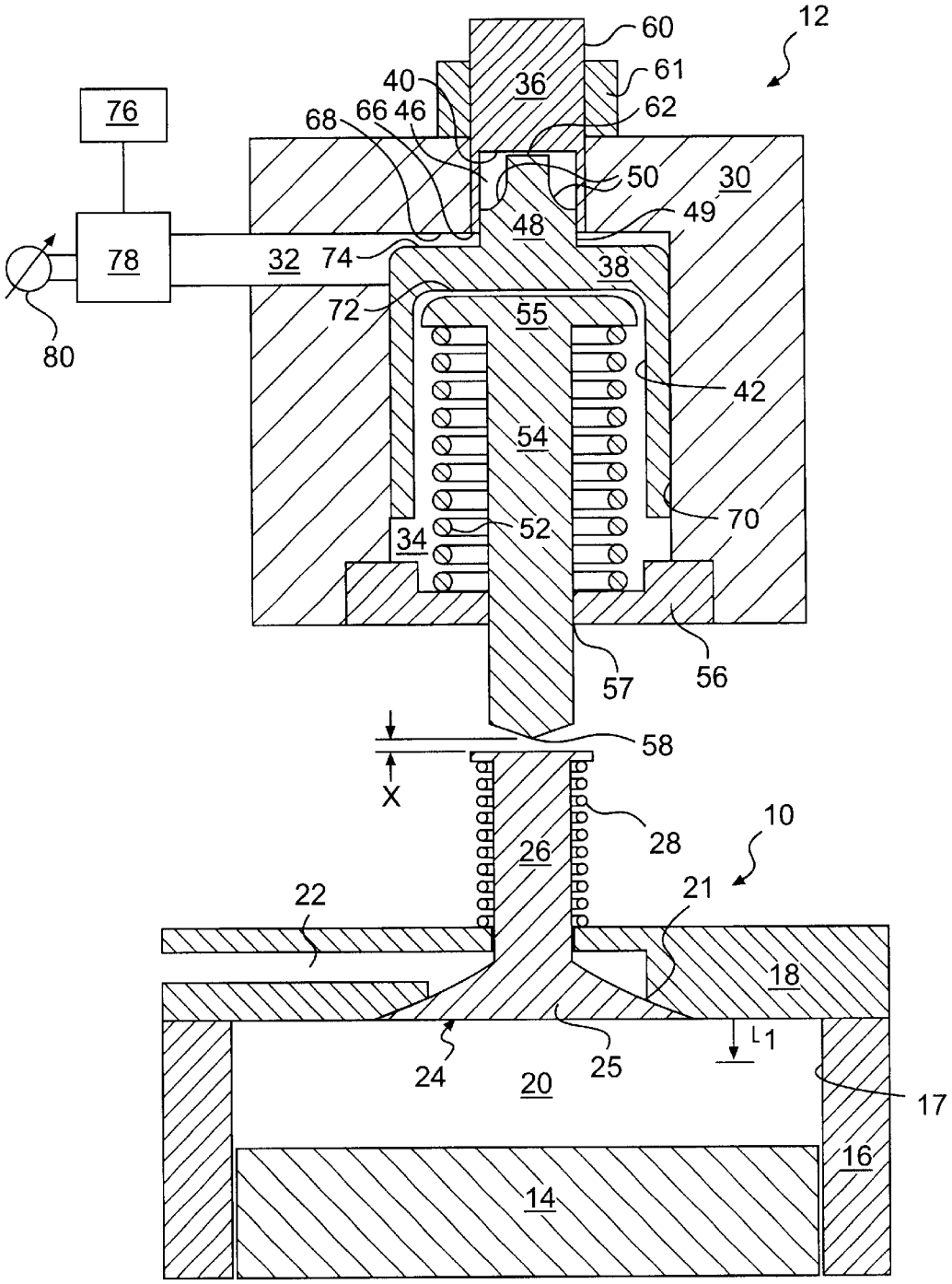
FIG. 1 is a cross-sectional view of an engine valve actuator in accordance with an exemplary embodiment of the present invention, illustrating a piston in a first position.

An exemplary embodiment of an engine valve actuator 12 for an internal combustion engine 10 is illustrated in FIG. 1.

Engine 10 includes an engine block 16 having a cylinder 17 that defines a combustion chamber 20. A cylinder head 18 may be engaged with engine block 16 to cover cylinder 17.

As also shown, a piston 14 may be disposed within cylinder 17. Piston 14 is adapted to reciprocate between a bottom-dead-center position and a top-dead-center position within cylinder 17. Piston 14 may be connected to a crankshaft (not shown) such that a rotation of the crankshaft causes piston 14 to reciprocate between the bottom-dead-center position and the top-dead-center position in cylinder 17. In addition, a reciprocating movement of piston 14 between the bottom-dead-center position and the top-dead-center position within cylinder 17 will cause a corresponding rotation of the crankshaft.

Engine 10 may, for example, operate in a conventional four stroke diesel cycle. In a four stroke diesel cycle, piston 14 moves through an intake stroke, a compression stroke, a combustion stroke, and an exhaust stroke. One skilled in the art will recognize that engine 10 may operate in other known operating cycles, such as, for example, an Otto cycle.

As also illustrated in FIG. 1, cylinder head 18 defines an opening 21 that leads to a passageway 22. For the purposes of the present disclosure, opening 21 and passageway 22 will be referred to as an exhaust opening and an exhaust passageway. One skilled in the art will recognize, however, that opening 21 and passageway 22 may also be an intake opening and an intake passageway.

Cylinder head 18 may define one or more additional exhaust openings as well as one or more intake openings and passageways that lead to and/or from combustion chamber 20. Exhaust passageway 22 may connect combustion chamber 20 with an exhaust manifold (not shown). An intake passageway may connect combustion chamber 20 with an intake manifold (not shown).

An engine valve 24 may be disposed in exhaust opening 22. For the purposes of the present disclosure, engine valve 24 will be referred to as an exhaust valve. One skilled in the art will recognize, however, that engine valve 24 may also be an intake valve.

Exhaust valve 24 may include a valve stem 26 and a valve element 25. Exhaust valve 24 may be moved between a first position and a second position. In the first position, exhaust valve 24 blocks exhaust opening 21 to prevent a flow of fluid from combustion chamber 20 to exhaust passageway 22. In the second position, exhaust valve 24 allows fluid to flow from combustion chamber 20 to exhaust passageway 22.

A valve actuation system (not shown) may be provided to actuate exhaust valve 24. As one skilled in the art will recognize, the valve actuation system may be a cam-driven system, a hydraulically driven system, an electrically driven system, or a combination thereof. The valve actuation system may be adapted to exert a force on valve stem 26 to thereby move exhaust valve 24 from the first position to the second position. A valve return spring 28 may be engaged with valve stem 26 to return exhaust valve 24 to the first position when the force exerted by the valve actuation system is removed.

The valve actuation system may be adapted to coordinate the opening of exhaust valve 24 with the movement of piston 14. For example, the valve actuation system may open exhaust valve 24 when piston 14 is moving through an exhaust stroke. In this manner, exhaust gases created during the combustion of fuel in combustion chamber 20 may be exhausted to exhaust passageway 22.

Engine 10 may also include a fuel injection system (not shown). The fuel injection system may deliver, for example, diesel fuel, gasoline, or natural gas to combustion chamber 20. The fuel injection system may be configured to inject a certain quantity of fuel into combustion chamber 20 at a certain point in the operating cycle of engine 10. For example, the fuel injection system may inject a quantity of diesel fuel into combustion chamber 20 as piston 14 moves from a top-dead-center position towards a bottom-dead-center position during an intake stroke.

As also shown in FIG. 1, valve actuator 12 includes a housing 30. Housing 30 has an inner surface 68 and defines a fluid passageway 32 and an opening 34. A source of pressurized fluid 80, which may be, for example, a variable capacity pump, may supply a flow of pressurized fluid to opening 34 through fluid passageway 32. A control valve 78 may be disposed in fluid passageway 32 to control the rate of fluid flow through fluid passageway 32.

An adjustment member 36 may be disposed in housing 30. Adjustment member 36 defines a chamber 46 that includes a seat 40. Adjustment member 36 includes a shoulder 66 that surrounds chamber 46. Adjustment member 36 is positioned in housing 30 to expose chamber 46 to opening 34.

Adjustment member 36 and housing 30 may be adapted to allow adjustment of the position of seat 40 and shoulder 66 relative to housing 30. For example, an outer surface 60 of adjustment member 36 may include threads that are configured to engage corresponding threads in housing 30. Adjustment member 36 may be rotated to thereby adjust the position of adjustment member 36 relative to housing 30. One skilled in the art will recognize that the position of adjustment member 36 relative to housing 30 may be adjusted through other known methods and/or devices, such as, for example, a spring-loaded ball and detent mechanism.

A nut 61 may be engaged with the threads of adjustment member 36. When adjustment member 36 is properly positioned with respect to housing 30, nut 61 may be tightened to secure adjustment member 36 to housing 30. In this manner, further movement of adjustment member 36 relative to housing 30 may be prevented.

Figure 2:
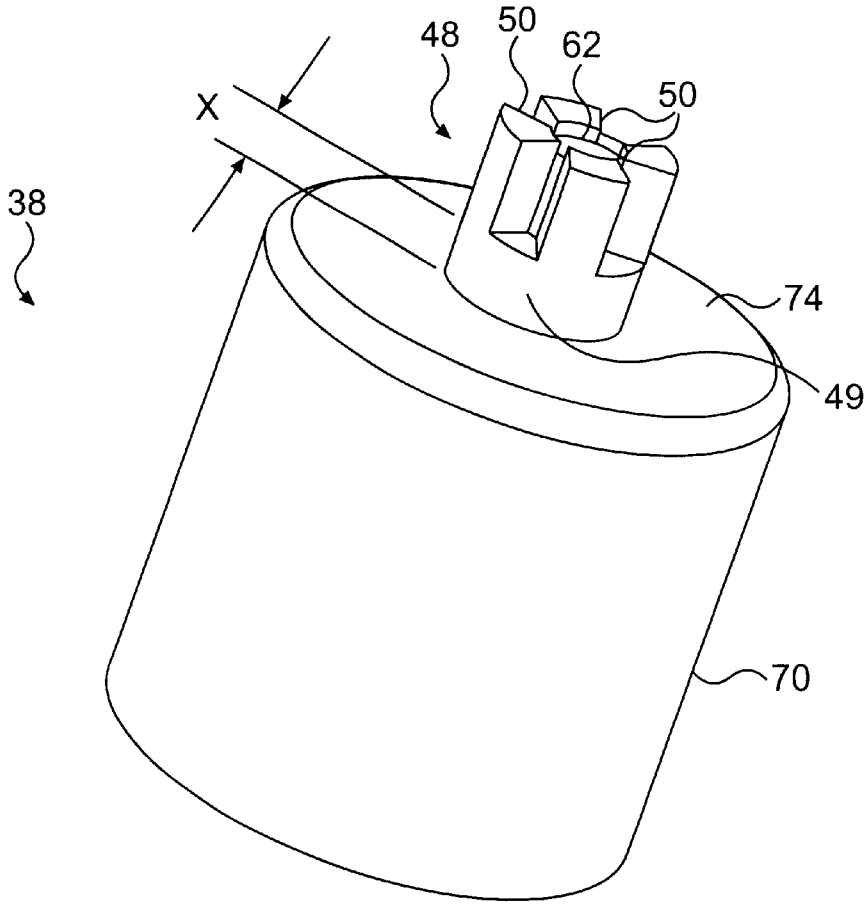
FIG. 2 is a pictorial view of a piston in accordance with an exemplary embodiment of the present invention.

Valve actuator 12 also includes a piston 38, which may be, for example, a slave piston. As shown in FIG. 2, piston 38 includes a pressure surface 74 and an outer surface 70. Piston 38 also includes a protrusion 48 that extends from pressure surface 74 to a face 62. Protrusion 48 may include an outer surface 49. One or more slots 50 may be formed in outer surface 49. Slots 50 may be formed in protrusion 48 to start at a distance, x, from pressure surface 74 and extend to face 62. Slots 50 may extend, for example, for approximately half of the height of protrusion 48.

As shown in FIG. 1, piston 38 also includes an inner surface 42 and a contact surface 72. Piston 38 may be slidably disposed in opening 34 of housing 30. Outer surface 70 of piston 38 may be adapted for a close tolerance fit with opening 34. In addition, a seal (not shown) may be disposed between outer surface 70 of piston 38 and housing 30. Chamber 46 of adjustment member 36 is adapted to receive protrusion 48 of piston 38 with a close tolerance fit.

Figure 3:
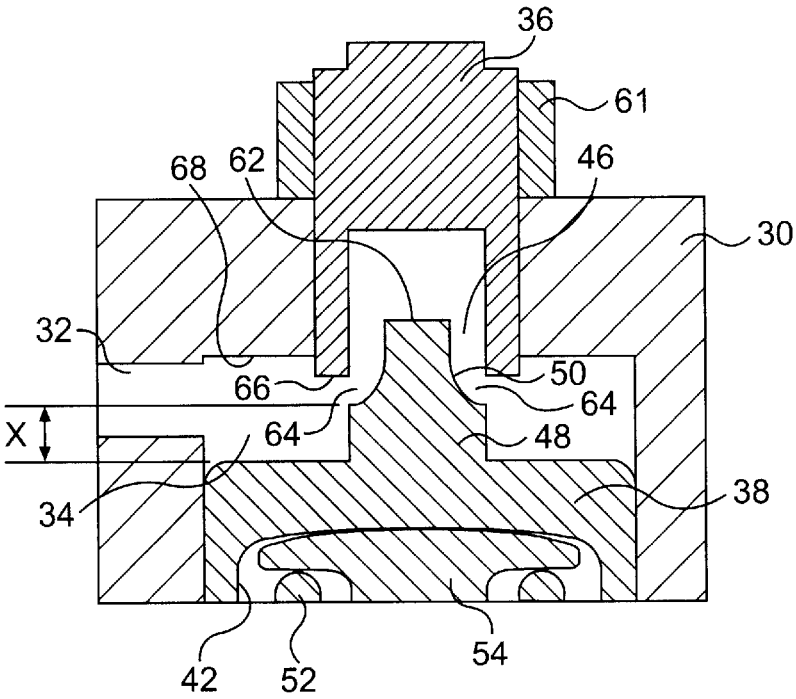
FIG. 3 is a partial cross-sectional view of an engine valve actuator in accordance with an exemplary embodiment of the present invention, illustrating a piston in a second position.
Figure 4:
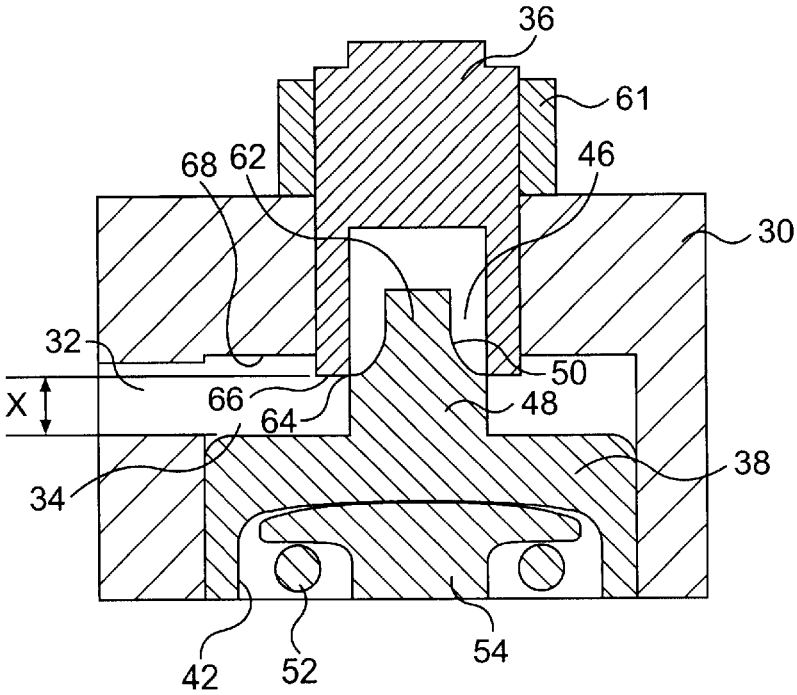
FIG. 4 is a partial cross-sectional view of an engine valve actuator in accordance with an exemplary embodiment of the present invention, illustrating a piston between the first and second positions.

Piston 38 may be moved relative to housing 30 and adjustment member 36 between a first position and a second position. In the first position, protrusion 48 is fully disposed in chamber 46 so that a portion of piston 38 engages a portion of adjustment member 36 or housing 30. For example, when piston 38 is in the first position, face 62 of protrusion 48 may engage seat 40 of chamber 46. Alternatively, when piston 38 is in the first position, pressure surface 74 of piston 38 may engage shoulder 66 of adjustment member 36 or inner surface 68 of housing 30. As shown in FIG. 3, when piston 38 is in the second position, slots 50 provide a fluid passageway 64 between opening 34 of housing 30 and chamber 46 of adjustment member 36. As shown in FIG. 4, as piston 38 moves from the second position to the first position, slots 50 will move past shoulder 68 of adjustment member 36 to close fluid passageway 64.

As shown in FIG. 1, a push rod 54 may be adapted to engage piston 38. Push rod 54 includes a head 55 that may engage contact surface 72 of piston 38 and an end 58 that extends from housing 30. Push rod 54 may be adapted to move relative to housing 30 in response to a corresponding movement of piston 38. One skilled in the art will recognize that push rod 54 and piston 38 may be formed as a single piece or as separate pieces.

A piston return spring 52 may be disposed in housing 30. A plate 56 having an opening 57 that is configured to slidably receive push rod 54 may be engaged with housing 30 on one side of piston return spring 52. Piston return spring 52 may act between plate 56 and head 55 of push rod 54. Piston return spring 52 acts to move push rod 54 and piston 38 to engage face 62 of protrusion 48 with seat 40 of chamber 46.

A controller 76 may be connected to control valve 78. Controller 76 may be an electronic control module that includes a microprocessor and memory. As is known to those skilled in the art, the memory may be connected to the microprocessor and may store an instruction set and variables. Associated with the microprocessor and part of the electronic control module may be various other known circuits such as, for example, power supply circuitry, signal conditioning circuitry, and solenoid driver circuitry, among others.

As one skilled in the art will recognize, controller 76 may be programmed to control one or more aspect of the operation of engine 10. For example, controller 76 may be programmed to control the position of control valve 78, the operation of source of pressurized fluid 80, and the operation of the fuel injection system (not shown).

INDUSTRIAL APPLICABILITY

Engine 10 may be operated to provide power to propel a vehicle, such as, for example, an automobile, an on highway truck, or an off highway truck. Engine 10 may be operated in a conventional four stroke diesel cycle. For the purposes of the present disclosure, the operation of a single cylinder 17 of engine 10 will be described.

During a conventional operation cycle of engine 10, piston 14 moves from a top-dead-center position towards a bottom-dead-center position in an intake stroke. As piston 14 moves through the intake stroke, the engine valve actuation system opens an intake valve (not shown) associated with combustion chamber 20. The opening of the intake valve allows intake air to flow from an intake manifold (not shown) into combustion chamber 20. The intake air may be at ambient pressure or the intake air may be pressurized such as, for example, by a turbocharger.

A fuel injection system injects a quantity of fuel during the intake stroke of piston 14. The fuel may be injected directly into combustion chamber 20 or into the intake manifold. The fuel mixes with the intake air to form a combustible mixture.

Piston 14 then moves from the bottom-dead-center position towards the top-dead-center position of a combustion stroke. The movement of piston 14 within combustion chamber 20 compresses the air and fuel mixture. Engine 10 may be adapted so that piston 14 compresses the air and fuel mixture to reach the critical, or combustion, pressure when piston 14 is at or near the top-dead-center position of the compression stroke.

When the fuel and air mixture reaches the ignition pressure, the fuel ignites and the mixture is combusted. The combustion of the fuel and air mixture drives piston 14 towards the bottom-dead-center position in a combustion stroke. The driving power of the fuel combustion is translated into an output rotation of a crankshaft (not shown) that is used to propel the vehicle.

Piston 14 then returns from the bottom-dead-center position to the top-dead-center position in an exhaust stroke. During the exhaust stroke, the engine valve actuation system moves exhaust valve 24 towards the second position to create a fluid passageway from combustion chamber 20 to exhaust passageway 22. The movement of piston 14 towards the top-dead-center position forces combustion exhaust from combustion chamber 20 into exhaust passageway 22. The operating cycle of piston 14 may then begin again with another intake stroke.

When a vehicle operator provides an instruction to decelerate the vehicle, such as, for example, by depressing a brake pedal, the engine may operate in an "engine braking" mode. Controller 76 may instruct the fuel delivery system to cease delivery of fuel to combustion chambers 20. The controller may also operate control valve 78 to activate valve actuator 12 to assist in the deceleration of the vehicle.

In the "engine braking" mode, controller 76 opens control valve 78 to allow pressurized fluid to flow from source of pressurized fluid 80 through fluid passageway 32 into opening 34. The pressurized fluid exerts a force on pressure surface 74 of piston 38, which causes piston 38 to move from the first position, as illustrated in FIG. 1, towards the second position, as illustrated in FIG. 3. This movement of piston 38 causes a corresponding movement of push rod 54. In addition, this movement of piston 38 opens fluid passageway 64 to allow fluid to flow from opening 34 through slots 50 and into chamber 46.

As push rod 54 moves relative to housing 30, end 58 of push rod 54 will move through distance x (referring to FIG. 1) to engage exhaust valve 24. Push rod 54 may directly engage valve stem 26. Alternatively, push rod 54 may engage another portion of exhaust valve 24 or an operative portion of the valve actuation system such as, for example, a bridge connecting a pair of exhaust valves 24 for combustion chamber 20.

The continued movement of piston 38 and push rod 54 after end 58 engages exhaust valve 24 causes exhaust valve 24 to move from the first position towards the second position to allow a flow of fluid from combustion chamber 20 to exhaust passageway 22. Controller 76 may control the opening of control valve 78 so that exhaust valve 24 opens when piston 14 is at or near the top-dead-center position of the compression stroke. As will be apparent to one skilled in the art, exhaust valve 24 may be opened at another point in the operating cycle of the engine to implement another variation on conventional engine valve timing.

When exhaust valve 24 is opened at the end of a compression stroke, the air compressed by piston 14 escapes from combustion chamber 20 through exhaust passageway 22. The act of compressing air will act to oppose the motion of the crankshaft. Because the air compression does not result in fuel combustion, the piston is not driven through a combustion stroke. Thus, valve actuator 12 causes engine 10 to operate as an air compressor that absorbs the kinetic energy of the moving vehicle by opposing the rotation of the crankshaft. Valve actuator 12 will, therefore, assist in the slowing of the moving vehicle.

To release engine valve actuator 12 and allow engine valve 24 to close, controller 76 may close control valve 78 and allow fluid to drain from opening 34. As the fluid drains from opening 34, the force exerted on pressure surface 74 of piston 38 decreases. Eventually, the force of valve return spring 28 and piston return spring 52 will allow engine valve 24 to move towards the first position and block exhaust opening 21

Piston return spring 52 will continue to act on piston 38. Protrusion 48 may remain in at least partial engagement with chamber 46 to guide piston 38 as it moves relative to housing 30. As protrusion 48 moves relative to chamber 46, the fluid in chamber 46 flows through slots 50 and fluid passageway 64 to return to opening 34. When, however, slots 50 pass shoulder 66 of adjustment member 36 (as illustrated in FIG. 4), fluid passageway 64 is effectively closed. When this occurs, the fluid remaining in chamber 46 is trapped. The fluid trapped in chamber 46 prevents further movement of piston 38 relative to housing 30 and adjustment member 36. Push rod 54 will stop at a position that is closer to engine valve 24 than if piston 38 returned to the first position.

When piston 14 next approaches the top-dead-center position of the compression stroke, the distance that piston 38 needs to move to open engine valve 24 is reduced by the distance, x. Thus, when controller 76 opens control valve 78, less fluid and less time is required to move piston 38 and push rod 54 to open engine valve 24. In this manner, the response time of engine valve actuator 12 to the introduction of pressurized fluid to housing 30 may be improved.

When engine 10 is no longer experiencing the engine braking conditions, controller 76 will close control valve 78 and allow fluid to drain from opening 34. The fluid trapped in chamber 46 will leak between protrusion 48 and adjustment member 36. This will allow piston 38 to return to the first position, where pressure surface 74 of piston 38 engages shoulder 66 of adjustment member 36 or face 62 of protrusion 48 engages seat 40 of chamber 46.

The starting position of piston 38 and push rod 54 relative to engine valve 24 may be adjusted by re-positioning adjustment member 36 relative to housing 30. By adjusting the threads on outer surface 60 of adjustment member 36 to move adjustment member 36 towards exhaust valve 24, the distance, x, separating push rod 54 from engine valve 24 may be decreased. By adjusting the threads on the outer surface 60 of adjustment member 36 to move adjustment member 36 away from exhaust valve 24, the distance, x, separating push rod 54 from engine valve 24 may be increased.

While the engine valve actuator of the present disclosure has been described in relation to an engine braking condition, one skilled in the art will recognize that the described engine valve actuator may be used to implement other variations on a conventional valve actuation timing when the engine is experiencing other operating conditions. For example, the described engine valve actuator may cooperate with an intake valve to implement a "late intake" type Miller cycle when the engine is experiencing certain operating conditions, such as, for example, steady state conditions.

As will be apparent from the foregoing description, the present disclosure provides an engine valve actuator that removes the lash between the engine valve actuator and the associated engine valve. This reduces the amount of travel distance that the valve actuator must travel to open the associated engine valve. Accordingly, the amount of time and fluid required to open the engine valve is reduced. This may improve control over the timing of the engine valve actuation and thereby lead to enhanced performance of the internal combustion engine.

It will be apparent to those skilled in the art that various modifications and variations can be made in the engine valve actuator of the present invention without departing from the scope of the disclosure. Other embodiments of the engine valve actuator will be apparent to those skilled in the art from consideration of the specification and practice of the valve actuator disclosed herein. It is intended that the specification and examples be considered as exemplary only, with a true scope of the disclosure being indicated by the following claims and their equivalents.

What is claimed is:

1. An engine valve actuator for an internal combustion engine, comprising:

a housing having an opening;

an adjustment member disposed in the housing and defining a chamber;

a piston disposed in the opening of the housing and having a protrusion adapted to be received in the chamber of the adjustment member, the piston having a first position where the protrusion of the piston is disposed in the chamber and a portion of the piston contacts a corresponding portion of the adjustment member and a second position where the portion of the piston is separated from the corresponding portion of the adjustment member;

a fluid passageway adapted to provide pressurized fluid to the opening to act on the piston to move the piston towards the second position to thereby allow pressurized fluid to enter the chamber to prevent the piston from returning to the first position; and a push rod operatively engaged with the piston, the push rod adapted to engage and open the engine valve.

2. The engine valve actuator of claim 1, wherein the piston includes a pressure surface and the protrusion of the piston extends from the pressure surface and includes an outer surface, a face, and at least one slot formed in the outer surface of the protrusion and extending from the face towards the pressure surface.

3. The engine valve actuator of claim 2, wherein the adjustment member includes a shoulder and the portion of the piston is the pressure surface and the corresponding portion of the adjustment member is the shoulder.

4. The engine valve actuator of claim 2, wherein the chamber of the adjustment member includes a seat and the portion of the piston is the face of the protrusion and the corresponding portion of the adjustment member is the seat of the chamber.

5. The engine valve actuator of claim 2, wherein the at least one slot extends for approximately half of the height of the protrusion.

6. The engine valve actuator of claim 1, wherein the adjustment member and the housing include corresponding threads that allow the adjustment member to be moved relative to the housing.

7. The engine valve actuator of claim 1, further including a control valve configured to control a flow of pressurized fluid through the fluid passageway.

8. The engine valve actuator of claim 1, further including a return spring acting on the piston to return the piston to the first position.

9. A method of actuating an engine valve of an internal combustion engine, comprising:

providing pressurized fluid to a housing defining an opening and including a chamber;

directing the pressurized fluid to the opening of the housing and against a piston having a protrusion engaged with the chamber, the pressurized fluid acting on the piston to move the piston from a first position where a portion of the piston engages a corresponding portion of the housing, the movement of the piston causing the engine valve to move to an open position and allowing fluid to flow into the chamber; and returning the engine valve to a closed position, the movement of the engine valve acting to move the piston within the housing, the fluid in the chamber preventing the piston from returning to the first position.

10. The method of claim 9, further including adjusting the position of the seat of the chamber relative to the housing.

11. The method of claim 9, wherein the pressurized fluid is provided to the housing when the internal combustion engine is experiencing one of a first set of operating conditions.

12. The method of claim 11, wherein the first set of predetermined operating conditions includes an engine braking condition.

13. The method of claim 1, further including stopping the flow of pressurized fluid to the housing when the internal combustion engine is experiencing one of a second set of operating conditions and wherein pressurized fluid escapes from the chamber to allow the piston to return to the first position.

14. An engine, comprising:

an engine block defining a cylinder;

a piston slidably disposed in the cylinder;

an engine valve moveable between a first position where a flow of fluid relative to the engine valve is prevented and a second position where a flow of fluid relative to the engine valve is allowed;

a housing having an opening;

an adjustment member disposed in the housing and defining a chamber;

a piston disposed in the opening of the housing and having a protrusion adapted to be received in the chamber of the adjustment member, the piston having a first position where the protrusion of the piston is disposed in the chamber and a portion of the piston contacts a corresponding portion of the adjustment member and a second position where the portion of the piston is separated from the corresponding portion of the adjustment member;

a fluid passageway adapted to provide pressurized fluid to the opening to act on the piston to move the piston towards the second position to thereby allow pressurized fluid to enter the chamber to prevent the piston from returning to the first position; and a push rod operatively engaged with the piston, the push rod adapted to engage and open the engine valve.

15. The engine of claim 14, further including a piston return spring acting to move the piston towards the first position and a valve return spring acting on the engine valve to close the engine valve.

16. The engine of claim 14, wherein the piston includes a pressure surface and the protrusion of the piston extends from the pressure surface and includes an outer surface, a face, and at least one slot formed in the outer surface of the protrusion and extending from the face towards the pressure surface.

17. The engine of claim 16, wherein the adjustment member includes a shoulder and the portion of the piston is the pressure surface and the corresponding portion of the adjustment member is the shoulder.

18. The engine of claim 16, wherein the chamber of the adjustment member includes a seat and the portion of the piston is the face of the protrusion and the corresponding portion of the adjustment member is the seat of the chamber.

19. The engine of claim 14, wherein the adjustment member and the housing include corresponding threads that allow the adjustment member to be moved relative to the housing.

20. The engine of claim 14, further including a control valve configured to control a flow of pressurized fluid through the fluid passageway.

* * * * *